US006894671B2

(12) United States Patent
Yamamoto et al.

(10) Patent No.: US 6,894,671 B2
(45) Date of Patent: May 17, 2005

(54) DISPLAY APPARATUS INCLUDING OPTICAL MODULATION ELEMENT

(75) Inventors: Tsunenori Yamamoto, Hitachi (JP); Ikuo Hiyama, Hitachi (JP); Shinichi Komura, Hitachi (JP); Tetsuya Aoyama, Hitachi (JP); Hajime Akimoto, Oume (JP); Katsuyuki Funahata, Hitachi (JP); Kazuhiro Kuwabara, Mobara (JP)

(73) Assignee: Hitachi, Ltd., Tokyo (JP)

( * ) Notice: Subject to any disclaimer, the term of this patent is extended or adjusted under 35 U.S.C. 154(b) by 135 days.

(21) Appl. No.: 09/817,217

(22) Filed: Mar. 27, 2001

(65) Prior Publication Data

US 2001/0048420 A1 Dec. 6, 2001

(30) Foreign Application Priority Data

May 30, 2000 (JP) ..... 2000-160825

(51) Int. Cl.[7] ..... G09G 3/36
(52) U.S. Cl. ..... 345/89; 345/92; 345/94
(58) Field of Search ..... 345/63, 88, 89, 345/90, 92, 97, 95, 98, 99, 100, 204, 205, 206, 690, 691, 692, 693

(56) References Cited

U.S. PATENT DOCUMENTS 5,724,058 A * 3/1998 Choi et al. ..... 345/89
5,798,746 A * 8/1998 Koyama ..... 345/98
5,959,598 A * 9/1999 McKnight ..... 345/92
5,977,940 A * 11/1999 Akiyama et al. ..... 345/94
6,023,308 A * 2/2000 Takemura ..... 349/42
6,456,266 B1 * 9/2002 Iba et al. ..... 345/87

FOREIGN PATENT DOCUMENTS

EP 0797182 A1 * 3/1997

* cited by examiner

*Primary Examiner*—Chanh Nguyen
*Assistant Examiner*—Paul Bell
(74) *Attorney, Agent, or Firm*—Antonelli, Terry, Stout & Kraus, LLP

(57) ABSTRACT

A display apparatus is capable of adapting sufficiently to an increase in the display frequency even when using an optical modulation element which has a fairly low response speed and can rewrite an image at a high speed. The display apparatus separately performs mapping of display data for an optical modulation element of each pixel and application of gradation information. The display apparatus divides a display period of one frame into a plurality of sub-frames, controls the input value for the optical modulation element independently per each sub-frame in the plurality of sub-frames, and displays an image with a gradation display using the optical modulation element.

20 Claims, 11 Drawing Sheets

DISPLAY APPARATUS INCLUDING OPTICAL MODULATION ELEMENT

BACKGROUND OF THE INVENTION

The present invention relates to a display apparatus including an optical modulation element. More particularly, the invention relates to a display apparatus employing a luminance gradation modulation system.

In the recent years, there has been substantial progress in the reduction of thickness and weight of an image display apparatus. In place of a CRT, which has been a primary image display device, a flat panel display, such as a liquid crystal display, PDP (Plasma Display Panel) and ELD (Electroluminescent Display), has experienced rapid development.

On the other hand, concerning the performance of a display apparatus, in association with wide-spread use of the personal computer (PC), digital video disk (DVD) and digital television broadcasting, the provision of a display having high definition and high or multiple level gradation has become essential. Also, the demand for higher performance, particularly a higher level of definition in an image display apparatus, is expected to grow in the future.

The degradation of image quality when a wide dynamic image is displayed in a hold illumination type image display apparatus, such as a liquid crystal display device, has been reported in the Institute of Telecommunications Engineers Technical Report EID 96-4, pp. 19–26 (June, 1996). According to this report, due to the unmatching of a dynamic image in hold illumination and the radial motion of the human eye when following a dynamic image, bluing of the dynamic image can be caused, thereby to lower the image quality of the dynamic image display.

In the above-identified report, it has been indicated that a method of multiplying the frame frequency n times and other methods may eliminate or reduce any lowering of the image quality of the dynamic image display. In short, in order to attain a clear dynamic image in the hold illumination type display apparatus, such as a liquid crystal display device, the display frequency has to be made higher. However, as set forth above, in the current image display method or the driving system of an image display apparatus, the increasing of the display frequency is becoming close to the limit. Accordingly, for this fact, the foregoing method is difficult to realize in practice.

The conventional display method of displaying an image by rewriting at high speed corresponding to an increase of the display frequency has been disclosed in Japanese Patent Application Laid-open No. 11-75144 (1999), for example. In the disclosed display method, two memories and two kinds of means for a driving pixel according to the contents of the memories are provided per each pixel, including an optical modulation element. For all pixels forming a preliminarily displayed image, data is written in the first memory in each pixel. Subsequently, the contents of the first memories are transferred to the second memories all together simultaneously for effecting ON and OFF control of the light at each pixel according to data in the second memories at high speed for PWM (pulse width modulation) control for multiple level gradation image display.

The above-mentioned prior art encounters a problem in multiple-level gradation display performance since no consideration has been given to the necessity for provision of a high speed optical modulation element for each pixel. Namely, since the conventional display method obtains multiple level gradation display by PWM control, a high response speed is required for the optical modulation element used in each pixel.

In this regard, in the prior art, a ferroelectric liquid crystal or antiferroelectric liquid crystal, for example, is used for the optical modulation element. Such a liquid crystal device requires a difficult fabrication process, such as orientation control or gap adjustment. Also, since the electrostatic capacity thereof is relatively large, the drive control is difficult.

Furthermore, in PWM control, it is not possible to drive the display in a saturated luminance output (=all white display) condition over an entire period of one frame. Therefore, there is a limitation in the light using efficiency and illumination period efficiency, thereby making it difficult to attain a gradation display at a maximum value.

SUMMARY OF THE INVENTION

It is an object of the present invention to provide a display apparatus in which it is possible to sufficiently increase the display frequency even with an optical modulation element which has fairly low response speed and to rewrite an image at a high speed.

By permitting use of an optical modulation element having a low response speed, the number of different kinds of the available optical modulation elements capable of being used can be increased, such as TN type or IPS type liquid crystal element, and elements which are easy to control in the mass production process or drive control may be used.

On the other hand, another object of the present invention is to provide a bright and high performance display apparatus which can satisfactorily provide an improved light use efficiency or illumination period efficiency.

According to one aspect of the invention, in a display apparatus having a system for separately performing mapping of display data for the optical modulation element of each pixel and application of gradation information, a display period of one frame is divided into a plurality of sub-frames; the input value for the optical modulation element is controlled independently per each sub-frame in the plurality of sub-frames; and an image is displayed with a gradation display by the optical modulation element.

The optical modulation element may be constructed with a liquid crystal having response speed longer than or equal to 5 msec.

The mapping of the display data for the optical modulation element may be performed with a construction in the form of a substantially orthogonal two signal wiring and a first active element arranged at the intersection of the two signal wiring for performing mapping of the display data in a first memory of each pixel, and application of gradation information for the optical modulation element may be performed by transferring the display data mapped in the first memory to a second memory in each pixel by a second active element in each pixel, and an input value is transferred to the optical modulation element by a third active element in each pixel. In the alternative, the mapping of the display data for the optical modulation element is performed by mapping of the display data in a first memory in each pixel using a shift register incorporated per one stage in the pixel, and application of gradation information for the optical modulation element may be applied by transferring an input value to the optical modulation element according to the display data transferred to the first memory.

First gradation information may be applied simultaneously with mapping of the image data for the pixel.

Second gradation information is applied for the pixels independently of mapping, and luminance gradation modulation may be performed per sub-frame simultaneously using the first gradation information and the second gradation information for obtaining a gradation display.

When an image having a number of gradation levels of substantially $2^n$ is to be displayed, one frame period serving as a period for displaying one frame of screen image data may be divided into n number of equal period sub-frames; and, in each sub-frame, each pixel may be selected as having either a display condition or a non-display condition according to preliminarily mapped display data, and an input value for luminance gradation of the pixel to be displayed in each sub-frame may be mutually differentiated.

The input value for the luminance gradation of the pixel to be displayed in each sub-frame may be any one of 1B, 2B, $2^2$B, . . . $2^n$B, while taking the input value for the lowest luminance gradation are 1b. The total value or effective value of all sub-frames of the input values for luminance gradation of the pixel to be displayed in each sub-frame may be substantially equal to the input value required for a saturated luminance output of the optical modulation element. The pixel in a certain frame or a certain sub-frame may be displayed using information of the pixel in a preceding frame or preceding sub-frame in time.

When an image having a number of gradation levels of substantially $2^n$ is to be displayed, one frame period serving as a period for displaying one frame of screen image data may be divided into less than or equal to n number of equal period sub-frames, each pixel in each sub-frame may be selectively held at the input value for luminance gradation of a preceding frame according to the preliminarily mapped display data or newly applied input value, and the input values for luminance gradation to be newly applied in each sub-frame are mutually differentiated. The input value for the luminance gradation to be newly applied in each sub-frame may be adjusted according to detection of gradation information of the image to be displayed. When an image having a number of gradation levels of substantially $2^n$ is to be displayed, one frame period serving as a period for displaying one frame of screen image data may be divided into less than n number of equal period sub-frames. The number of gradation levels of the display image may be detected and the number of sub-frames in one frame period adjusted depending upon the result of detection of the number of gradation levels. The number of sub-frames in one frame period may be adjusted by varying the number of gradation levels of the display image for adjusting the driving frequency. The number of sub-frames in one frame period may be adjusted by varying the number of gradation levels of the display image for adjusting one frame period. The number of gradation levels of the image to be displayed over several frame periods may be adjusted by adjusting the input value for luminance gradation to be newly applied in each sub-frame, per frame.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENTS

The present invention will be discussed hereinafter in detail in terms of the preferred embodiments of a display apparatus according to the present invention with reference to the accompanying drawings. In the following description, numerous specific details are set forth in order to provide a thorough understanding of the present invention. It will be obvious, however, to those skilled in the art that the present invention may be practiced without these specific details. On the other hand, well known structures are not shown in detail in order to avoid unnecessary obscurity of the present invention.

First Embodiment

The first embodiment of a display apparatus according to the present invention will be discussed with reference to the circuit diagram of FIG. 2.

Figure 2:
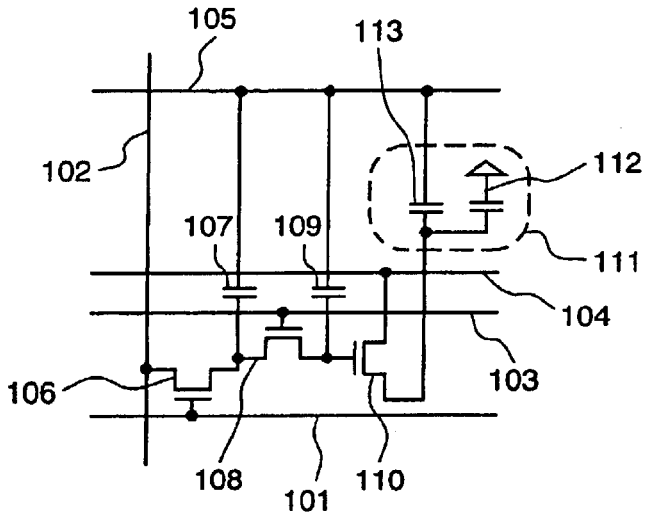
FIG. 2 is a circuit diagram of a pixel in the first embodiment of the invention.

As shown FIG. 2, the first embodiment of the display apparatus is constructed with a matrix formed of a scanning wiring 101, a control signal line 103, an applied voltage wiring 104 and a common wiring in a row direction and data signal wiring 102 in a column direction. Respective pixels are arranged at the intersection of respective lines of the matrix.

Here, each pixel is constructed with a first active element 106, a first pixel memory 107, a second active element 108, a second pixel memory 109, a third active element 110 and an optical modulation element 111. Also, the optical modulation element 111 is constructed with a liquid crystal 112 and a holding capacitor 113.

A gate terminal of the first active element 106 is connected to the scanning wiring 101. In this way, the first active element 106 is turned on when a selection voltage is applied to the line 101. At this time, the potential of the data signal wiring 102 is written in the first pixel memory 107.

Subsequently, when the selection voltage is applied to the control signal wiring 103, the second active element 108 disposed between the first pixel memory 107 and the second pixel memory 109 becomes conductive. Thus, the potential of the first pixel memory 107 is transferred to the second pixel memory 109.

Since the second pixel memory 109 is connected to the gate terminal of the third active element 110, the third active element 110 is controlled by the potential transferred to the second pixel memory 109 for applying a voltage of the applied voltage wiring 104 to the optical modulation element 111.

The foregoing operation is substantially equivalent to the operation of a display apparatus having a system separately performing mapping of the display data for the conventional optical modulation element and providing information. However, in the illustrated embodiment, TN (twisted nematic) type liquid crystal 112 is used as the optical modulation element 111. The third active element 110 is designed for writing the voltage of the applied voltage wiring 104 to the liquid crystal 112 and the holding capacitor 113. The liquid crystal 112 varies the orienting condition of the liquid crystal axis in a cell depending upon the written voltage to control the polarizing direction of the light, thereby to modulate the pixel luminance.

Next, the driving and display operation of the first embodiment of the display apparatus will be discussed with reference to FIG. 1.

In the first embodiment, one frame period 220, namely the display period of one screen image, is divided into a number of sub-frames 221 corresponding to the number n of gradation bits in the pixel of each color of R (red), G (green) and B (blue), which pixel of each color in one pixel will hereinafter be referred to as a "sub-pixel" or "pixel component". Here, the gradation level of the pixel component is controlled by four bits. Therefore, the number of gradation bits is four. Thus, one frame is divided into four sub-frames.

The scanning wiring 110 is sequentially selected from one side of the display screen in each sub-frame 221 to complete the scan within one sub-frame period. Namely, as a voltage 201 to be applied to one scanning wiring 101, the voltage is selected so as to be applied only once in one sub-frame period. It should be noted that, in FIG. 1, only the first sub-frame 221 is illustrated.

In response to the selection voltage to be applied to the scanning wiring, the first active element 106 becomes conductive. Here, the voltage 207 of the first pixel memory 107 is equal to the voltage 202 to be applied to the data signal wiring 102. As a result, in the first pixel memories 107 of all pixels of the display screen, the display data is mapped.

At this time, the display data for mapping is merely a signal having two values indicating selected and not selected, respectively. Therefore, even in consideration of wiring delay, mapping can be performed in quite a short period of time. Therefore, even within the sub-frame divided into n, satisfactory data mapping can be performed easily. It should be noted that one frame period in high speed display is about 1/60 of a second (=about 16.6 msec.) similarly to the NTSC system, for example.

As set forth above, after mapping the display data, the data transfer voltage 203 is applied to the control signal wiring 103. By this, the voltage 207 of the first pixel memory 107 is transferred to a potential 209 of the second pixel memory 109 so as to be maintained within the next sub-frame period.

Then, in accordance with the potential 209 of the second pixel memory 109, the conducting state of the third active element 110 is controlled. Then, it is determined whether the analog gradation value to be applied to the applied voltage wiring 104 is to be applied to the liquid crystal 112 or not based on the state of the third active element 110.

Here, in the case of the illustrated embodiment, the writing period of the analog gradation value for the optical modulation element 111 is comparable to the sub-frame period. Therefore, the writing period can be certainly obtained for facilitating writing.

On the other hand, in the illustrated embodiment, since writing of an analog gradation value for the optical modulation element 111 and mapping of the display data are separate operations, no blanking period is present at the interval between the sub-frames. Furthermore, high speed rewriting of an image becomes possible.

Figure 1:
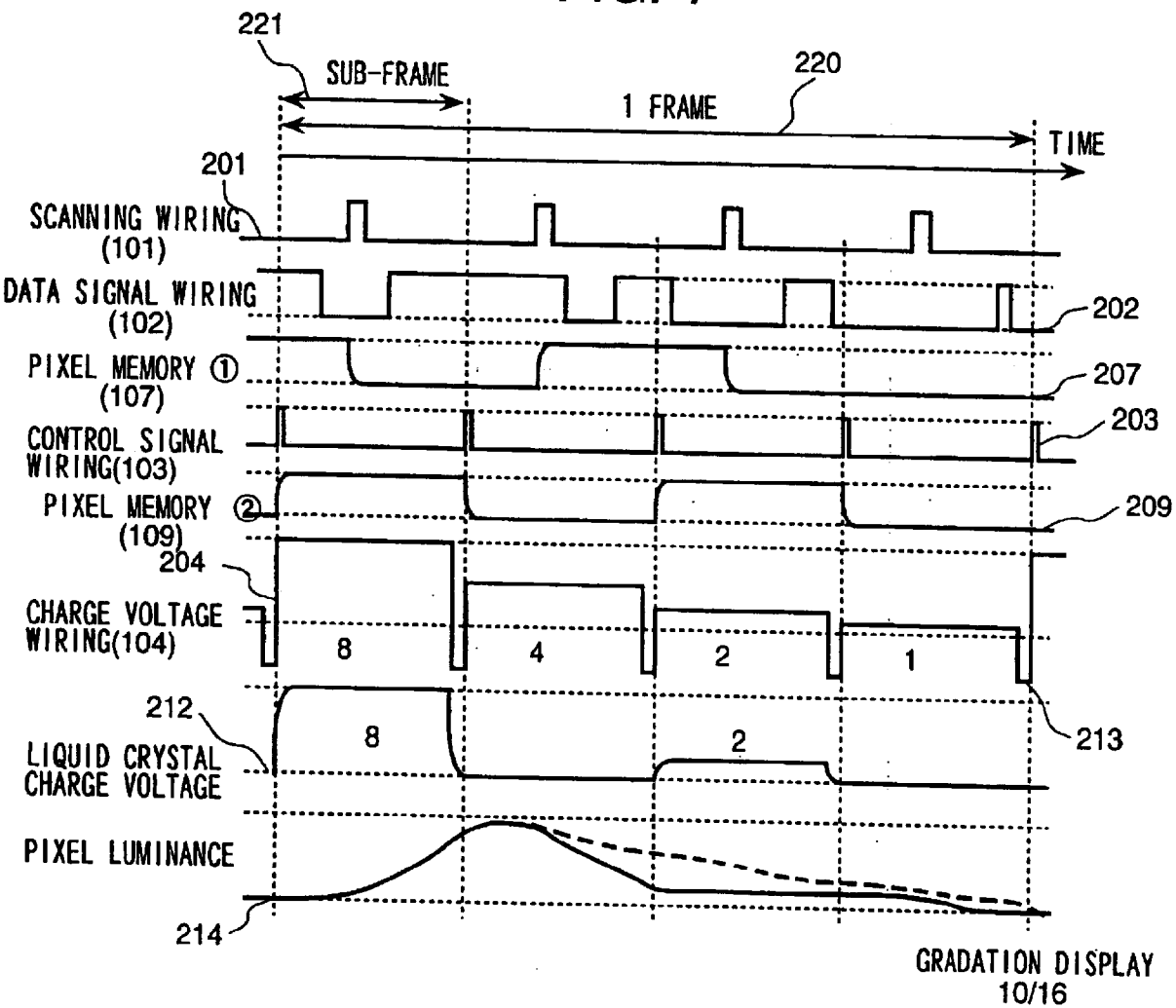
FIG. 1 is a waveform timing diagram of a driving condition in the first embodiment of a display apparatus according to the present invention.

Here, in the case of FIG. 1, since the voltage 209 of the second pixel memory 109 is in a selected condition in the first sub-frame and the third sub-frame, the voltage 204 of the applied voltage wiring 104 serves as the liquid crystal applied voltage 212.

Here, as shown, during the sub-frame period, at the final timing, the liquid crystal applied voltage clear pulse 213 is applied to the applied voltage wiring 104. Then, the liquid crystal applied voltage clear pulse is also applied to the common wiring 105, although this is not illustrated.

Accordingly, the third active element 110 is placed in a conductive state by the clear pulse 213. As a result, the liquid crystal applied voltage 212 is cleared at the end timing of each sub-frame. Therefore, in the sub-frame where the second pixel memory 109 is in a non-selected state, the voltage is not applied to the liquid crystal 112. The value of the liquid crystal applied voltage 212 is independent per sub-frame and can take a different value.

Then, when the value of the liquid crystal applied voltage 212 is applied to the liquid crystal, with reference to a voltage E for the lowest luminance value, namely a luminance value at the lowest gradation level, in one frame to be luminance modulated, the voltage levels for respective gradation levels are set to be $2^n$E (E is multiplied by 2 to the (n)th power, wherein n is an integer), namely, the voltage value 2E ($2=2^1$), the voltage value 4E ($4=2^2$) the voltage value 8E ($8=2^3$) $2^{n-1}$E (n is the number of sub-frames which equals the gradation bit number). This is one feature of the first embodiment.

Here, FIG. 1 shows the case where n=4, namely, where the number of gradation levels is 16 ($=2^4$). Accordingly, in the fourth sub-frame period, the voltage E for the lowest luminance value in one frame is applied to the applied voltage wiring 104, in the third sub-frame, the voltage 2E is applied, and in the second and first sub-frames, the voltages 4E and 8E are applied, respectively.

Then, assuming that the luminance is proportional to the applied voltage, and assuming that the luminance value for the voltage value E is L, the luminance at the voltage value 2E becomes 2L. Similarly, at the voltage 4E, the luminance value becomes 4L, at the voltage 8E, the luminance value becomes 8L, and at the voltage value $2^{(n-1)}$E, the luminance value becomes $2^{(n-1)}$L.

It should be appreciated that the liquid crystal is an element used for controlling the light transmission amount. Strictly, the liquid crystal does not control luminance. However, from the viewpoint of pixel display, it should be the same. Therefore, the discussion will be given as if luminance is being controlled.

In the case of FIG. 1, the voltage 209 of the second pixel memory 109 becomes high level in the first sub-frame period and the third sub-frame period. Accordingly, in the first sub-frame period, the liquid crystal 112 is at the luminance level 8L, and in the third sub-frame period, the liquid crystal 112 is at luminance level 2L. As a result, during this frame period, the gradation display by the optical modulation element 111 becomes 10/16.

In the first embodiment, a TN type liquid crystal is employed as the liquid crystal 112. At this time, among TN systems, one having a relatively short response period, e.g. 5 msec., is selected. Therefore, as shown in FIG. 1, when the voltage is applied to the liquid crystal 112 during the first sub-frame period and the third sub-frame period, the pixel luminance 214 has a luminance display characteristics in which a peak is reached after the first sub-frame, as shown by solid line, and subsequently it is lowered slowly.

Here, FIG. 1 shows the case where the voltage is applied to the first sub-frame and the third sub-frame, and, at this time, the gradation display is 10/16. However, when the voltage is applied to the liquid crystal at all of the sub-frames, the display characteristics become as shown by the broken line to produce the maximum luminance.

Accordingly, in case of the illustrated embodiment, by selected combination of the sub-frames in which to apply the voltage, sixteen kinds of gradation in the display can be obtained. Namely, in the illustrated embodiment, one frame period 220 is divided into a plurality of sub-frames. Then, by applying an independent voltage to the optical modulation element 111 during each sub-frame, a selected gradation display can be obtained. Hereinafter, the multiple level gradation display method as set forth above will be referred to as a sub-frame luminance gradation modulation method.

Accordingly, in the illustrated embodiment, since the liquid crystal 112 forming the optical modulation element 111 is not subject to high frequency switching control, as opposed to the prior art employing PWM, even for a display apparatus having a high display frequency and a large number of gradation levels, it is not necessary to employ a liquid crystal material requiring a difficult manufacturing process or driving method, such as ferroelectric liquid crystal or antiferroelectric liquid crystal. Therefore, a TN type or IPS (In Plane Switching) type liquid crystal, which are typically used in the existing liquid crystal display apparatus, may be used as they are.

Figure 3:
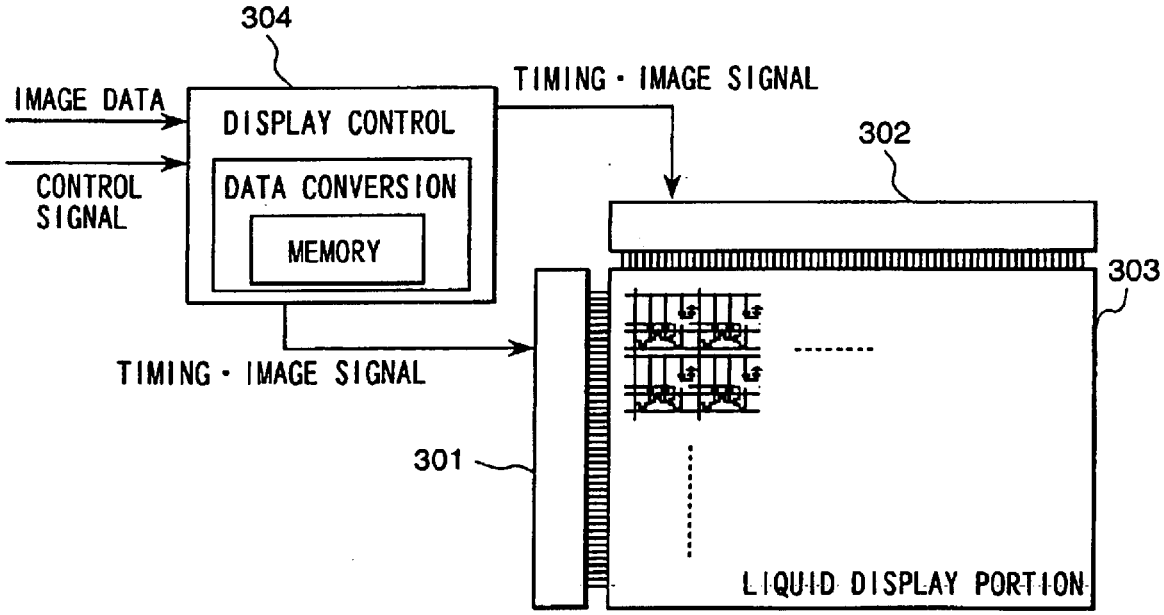
FIG. 3 is a diagram showing an overall construction of the first embodiment of the display apparatus according to the invention.

FIG. 3 shows the overall construction of the first embodiment of the display apparatus according to the invention.

A liquid crystal display portion 303 is formed by arranging pixels shown in FIG. 2 in a matrix fashion. In the left side portion of the liquid crystal display portion 303, a side portion wiring driving circuit 301 is arranged, and, on the upper portion, an upper side wiring driving circuit 302 is arranged.

As shown in FIG. 2, since the scanning wiring 101, the control signal wiring 103, the liquid crystal applied voltage wiring 104 and the common wiring 105 are arranged laterally (row direction), they are driven by the side portion wiring driving circuit 301; and, since the data signal wiring 102 is arranged in a vertical direction (column direction), it is driven by the upper portion wiring driving circuit 302.

It should be noted that wiring other than the scanning wiring 101 and the data signal wiring 102 might be arranged in the vertical direction instead of the lateral direction. Furthermore, the side portion wiring driving circuit 301 is not necessarily located at the left side, but can be on the right side. Also, the upper portion wiring driving circuit 302 is not necessarily located at the upper side, but can be on the lower side.

Here, in the illustrated embodiment, a display controller 304 is provided for receiving the image data and converting into the image data necessary for the driving method according to the present invention and for transferring the timing signal and the image data signal to the wiring driving circuit, in the display apparatus.

Figure 4:
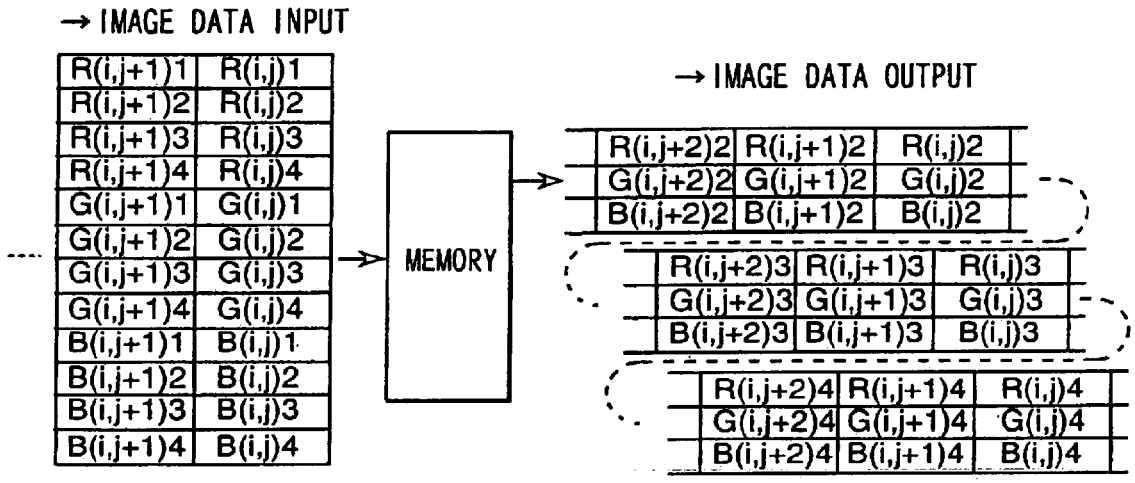
FIG. 4 is a diagram showing one example of data conversion in a display controller in the first embodiment of the present invention.

At this time, the image data is typically input as parallel chrominance data and gradation data of pixel (i, j) forming the screen image, as shown in the form of image data input in FIG. 4. Therefore, in the display controller, the input image data is first stored in the memory, converted and output to the image data of all pixels per gradation data bit, as shown in FIG. 4. It should be noted that, in the illustrated embodiment, after receiving normal image data, the image data is converted in the display controller 304. However, when the image data source can supply the image data shown as image data output in FIG. 4, a data converting portion of the display controller 304 becomes unnecessary.

As set forth above, in the first embodiment, the frame is divided into a plurality of sub-frames, the luminance control voltage to be applied to the optical modulation element is controlled into independent voltage value in each of the plurality of sub-frames to obtain a gradation display by a sub-frame luminance gradation modulation method. Therefore, even when the TN type or IPS type liquid crystals, which have a relatively low response speed, are employed, a display apparatus capable of high speed display can be obtained easily.

As a result, with the illustrated embodiment, the number of available kinds of useful optical modulation element capable of use is increased, thereby to increase the design margin, and facilitate manufacturing. Furthermore, when the TN type liquid crystal is used as in the described embodiment, mass production and driving control are facilitated so as to gain a superior position from the viewpoint of cost.

Second Embodiment

Figure 5:
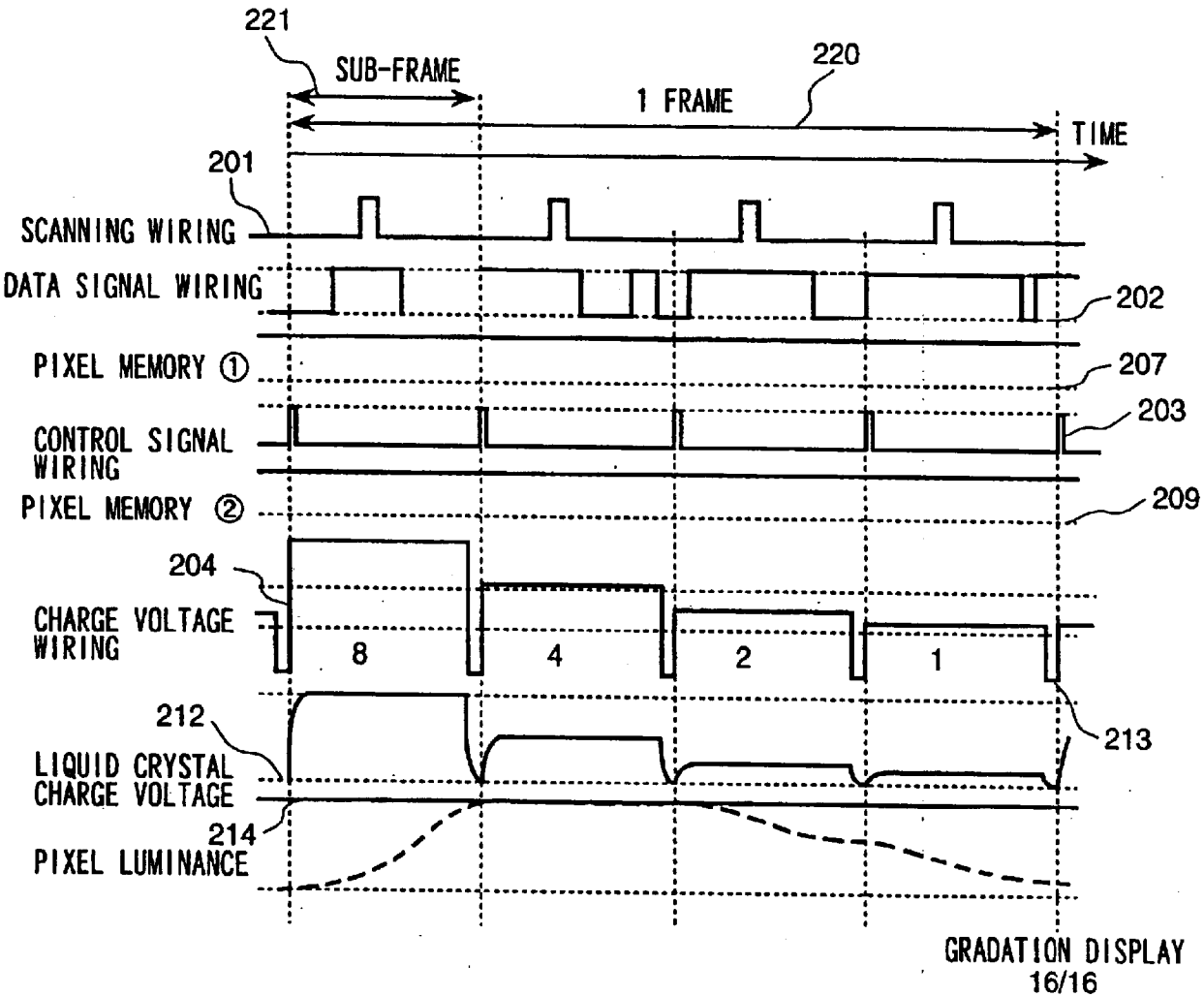
FIG. 5 is a waveform timing diagram showing a driving condition in the second embodiment of the present invention.

Next, a second embodiment of the present invention will be discussed. The second embodiment is similar to the first embodiment except for the driving operation, as shown in FIG. 5. Also, the driving of the scanning wiring 101, the data signal wiring 102, the control signal wiring 103, the active elements 106, 108 and the pixel memories 107, 109 is the same as that of the first embodiment.

On the other hand, the voltage 204 applied to the applied voltage wiring 104 is set to be $2^n$E (E is multiplied by 2 to the (n)th power, wherein n is an integer), namely, the voltage value 2E ($2=2^1$), the voltage value 4E ($4=2^2$), the voltage value BE ($8=2^3$), . . . $2^{n-1}$E (n is number of sub-frames which equals to gradation bit number) for establishing luminance 15 levels of one time, two times (double), square of 2, . . . 2 to the (n−1)th power of the reference or minimum luminance level, per sub-frame. However, in the second embodiment, the effective values of the voltage value to be applied in each sub-frame in all of the sub-frame periods (=one frame period) are set to be equal to the voltage value for attaining a saturated luminance output of the liquid crystal 112. This is another difference relative to the first embodiment.

In the second embodiment, as the optical modulation element 111, the liquid crystal 112 of TN type material having about 20 nsec is used. Therefore, the luminance value in each pixel is responsive to the effective value of the voltage within one frame period (=about 16.6 msec.). As a result, as shown in FIG. 5, when a gradation display corresponding to all white is output, as shown by pixel luminance 214 in solid line, a saturation luminance output can be obtained throughout one frame period.

It should be noted that the liquid crystal having a response period of about 5 msec., as employed in the first embodiment, could be employed. In this case, the gradation characteristics may be characteristics in the pixel luminance 214 of FIG. 5 in broken line. Even with this, a high pixel luminance output comparable with that of the first embodiment can be obtained.

Accordingly, even in the second embodiment, as a multiple gradation display method, the sub-frame luminance gradation modulation is used to make the effective input value (effective voltage value) in one frame period equal to the input value (voltage value) corresponding to the saturation luminance display. This enables use of an optical modulation element, such as TN type or IPS type liquid crystal, having a relatively low response speed. Furthermore, a saturated luminance output or luminance output can be obtained throughout one frame period to significantly improve the illumination efficiency, thereby to easily obtain a bright display.

Third Embodiment

Figure 6:
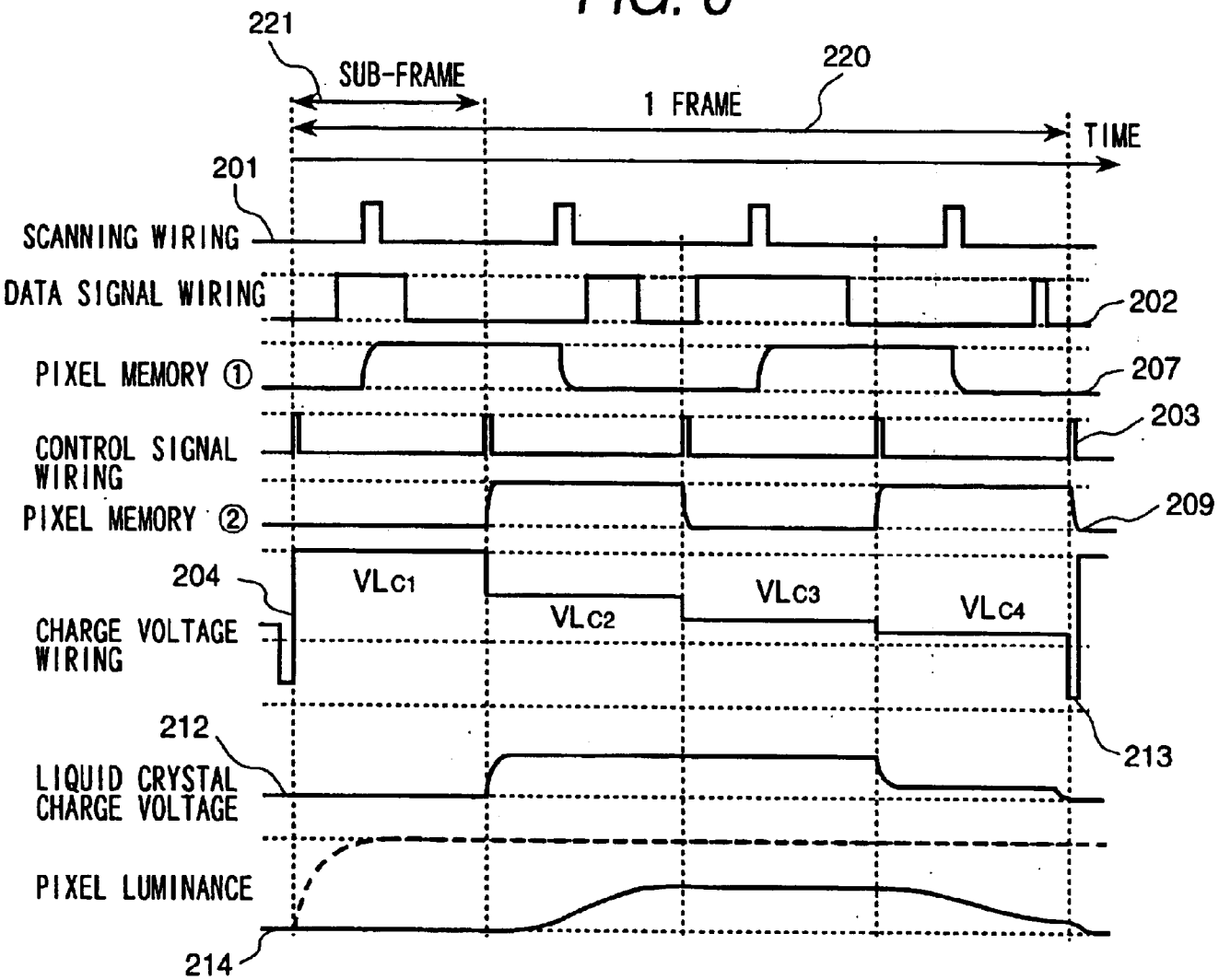
FIG. 6 is a waveform timing diagram showing a driving condition in the third embodiment of the present invention.

Next, a third embodiment of the present invention will be discussed. The third embodiment is similar to the first embodiment, except for the driving operation, as shown in FIG. 6. Also, driving of the scanning wiring 101, the data signal wiring 102, the control signal wiring 103, the active elements 106, 108 and the pixel memories 107, 109 is the same as that of the first embodiment.

However, in the third embodiment, the liquid crystal applied voltage clear pulse 213, which is applied at the end of each sub-frame in the first embodiment, is applied only once at the end of one frame period, in contrast to the first embodiment. Also, the voltage applied to the applied voltage wiring 104 per sub-frame is not the voltage values for establishing luminance levels of one time, two times (double), square of 2, . . . 2 to the (n−1)th power of the reference or minimum luminance level, per sub-frame as in the former embodiment.

As a result, in the third embodiment, the liquid crystal applied voltage clear pulse 213 is applied per sub-frame. Therefore, the voltage to be applied to the liquid crystal 112 in the pixel not to be written with the voltage from the applied voltage wiring 104 in each sub-frame is maintained at the voltage applied to the corresponding sub-frame in the preceding frame period.

In this case, the display data mapped in the first pixel memory 107 by the scanning wiring 101 and the data signal wiring 102 becomes data for selecting between holding at the voltage of the current sub-frame as the liquid crystal applied voltage 212 in the next sub-frame or writing the voltage to be newly applied to the applied voltage wiring 104.

Thus, in each sub-frame, luminance gradation modulation is realized by operation for selecting between maintaining the liquid crystal applied voltage in the preceding sub-frame period and newly writing the voltage, for obtaining gradation display. These are characteristics of the third embodiment.

In case of the third embodiment shown in FIG. 3, the second pixel memory 109 is in a selected condition in the second sub-frame and the fourth sub-frame. In these sub-frames, the voltage 204 of the applied voltage wiring 103 is written to the liquid crystal 112. In the first and third sub-frames, the liquid crystal applied voltage 212 of the preceding sub-frame is maintained as they are.

At this time, in the first sub-frame, the liquid crystal applied voltage 212 is cleared by the liquid crystal applied voltage clear pulse at the end of the immediately preceding frame period. Accordingly, holding the preceding voltage is equivalent to a holding of the clear condition.

Next, in the third embodiment, as shown in FIG. 6, the voltage 204 to be applied to the applied voltage wiring 104 becomes the voltage value $V_{LC1}$ corresponding to the saturated luminance output in the first sub-frame. Therefore, for the next sub-frame, the voltage values $V_{LC2}$, $V_{LC3}$, $V_{LC4}$ become sequentially lowered in a stepwise fashion.

Accordingly, in this case, since there is no liquid crystal applied voltage clear pulse between each of the sub-frames in one frame, the voltage shown as a saturated luminance output is applied to the liquid crystal applied voltage throughout the frame period. As a result, as shown by the broken line in FIG. 6, a high pixel luminance 214 can be obtained. Irrespective of the response period of the liquid crystal to be used, a saturated luminance can be output throughout one frame period.

As set forth, in the third embodiment, as a multiple gradation level display method, a sub-frame luminance gradation modulation is employed, in which the liquid crystal applied voltage of the preceding sub-frame is held or the newly applied voltage is selected. Even with a TN type or IPS type liquid crystal, a saturated luminance output or luminance output can be obtained throughout one frame period so as to significantly improve the illumination efficiency, thereby to easily obtain a bright display.

Fourth Embodiment

Next, a fourth embodiment of the present invention will be discussed.

Figure 7:
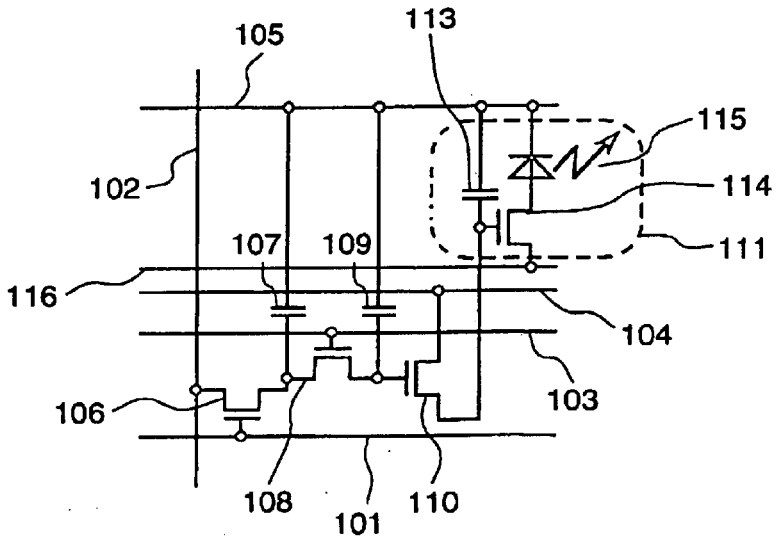
FIG. 7 is a circuit diagram of a pixel in the fourth embodiment of the present invention.

In the foregoing embodiments, as the optical modulation element 111, the Tn type or IPS type liquid crystal 112 is employed. As shown in FIG. 7, the fourth embodiment employs an organic EL element 115 as the optical modulation element 111. A current controlling active element 114 for controlling current to be supplied to the organic EL element 115 and a holding capacitor 113 connected to a gate terminal of the current controlling active element 114 for holding a voltage are employed. Thus, a light emitting element in the form of an organic EL element is used as the voltage control type optical modulation element similar to the liquid crystal.

On the other hand, as the wiring for supplying current to the organic EL element 115, a current supply wiring 116 is provided. The other construction is the same as that of the first to third embodiments. Accordingly, the fourth embodiment corresponds to a construction where the optical modulation element 111 shown in FIG. 2 is replaced with the optical modulation element 111 in FIG. 8. Therefore, a driving condition similar to the first to third embodiments can be used.

Accordingly, for example, as a multiple gradation level display method in the fourth embodiment, a method discussed 20 in the third embodiment may be applied to operate in sub-frame luminance gradation modulation by selecting between holding the organic EL control voltage or newly applying the voltage. When the organic EL element is used as the optical modulation element, a saturated luminance output can be obtained throughout one frame period to enable a bright display.

Fifth Embodiment

Next, the description of a fifth embodiment of the present invention will be given.

Figure 8:
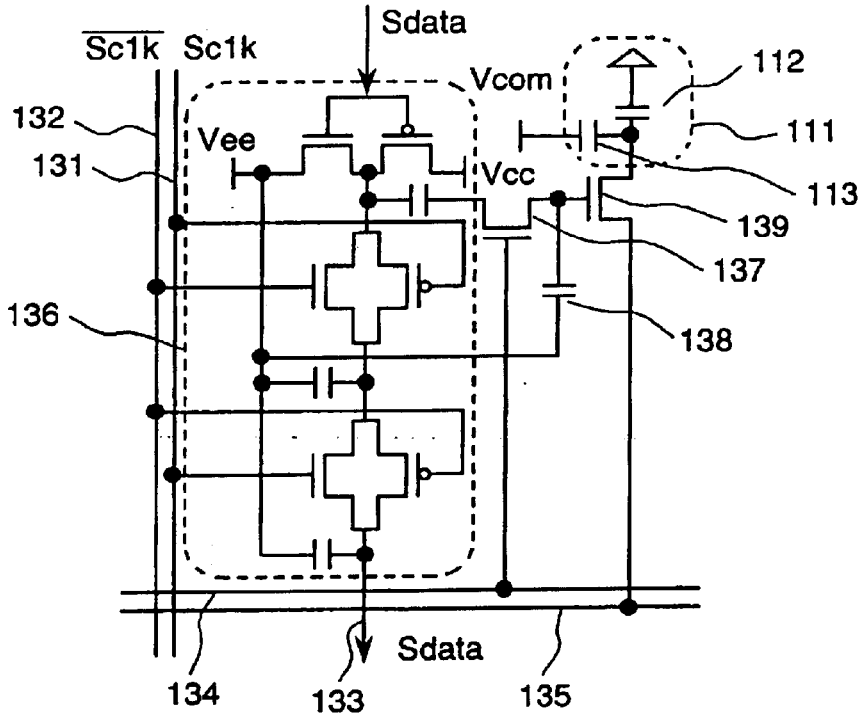
FIG. 8 is a circuit diagram of a pixel in the fifth embodiment of the present invention.

In the fifth embodiment, as each pixel of the liquid crystal display portion 303 in FIG. 3, the circuit construction shown in FIG. 8 is employed. The other construction is the same as that of the first to third embodiments. Here, in case of the fifth embodiment, as shown in FIG. 8, in each pixel, one stage shift register 136, to be shifted by a shift clock 131 and inverted shift clock 132, is provided. The shift register 136 operates to transfer shift data 133 in a vertical direction according to this applied clock pulse signal.

The shift data 133 held in the shift register 136 is transferred to the pixel memory 138 by placing the first active element 137 in a conductive state by selecting the control signal wiring 134. The pixel memory 138 is connected to the gate terminal of the second active element 139. Accordingly, the second active element 139 is controlled by a potential transferred to the pixel memory 138, and the voltage of the voltage wiring 135 is applied to the optical modulation element 111.

It should be noted that, in the fifth embodiment, the optical modulation element 111 is a liquid crystal similar to the first to third embodiments. However, the organic EL element may also be used, similar to the fourth embodiment.

Next, the driving state of the fifth embodiment of the display apparatus will be discussed with reference to FIG. 9.

The fifth embodiment is similar to the former embodiment in that one frame period 220 is divided into a plurality of sub-frames 221 in a number corresponding to the number of gradation bits in each pixel component. In the illustrated embodiment, instead of mapping the display data by an orthogonal matrix using the scanning wiring 101 and the data signal wiring 102, by using a group of shift registers 136 formed by a pixel group in the vertical direction, using the shift register signal 236 synchronous with the shift clock 231 per sub-frame, display data is mapped per sub-frame.

Figure 9:
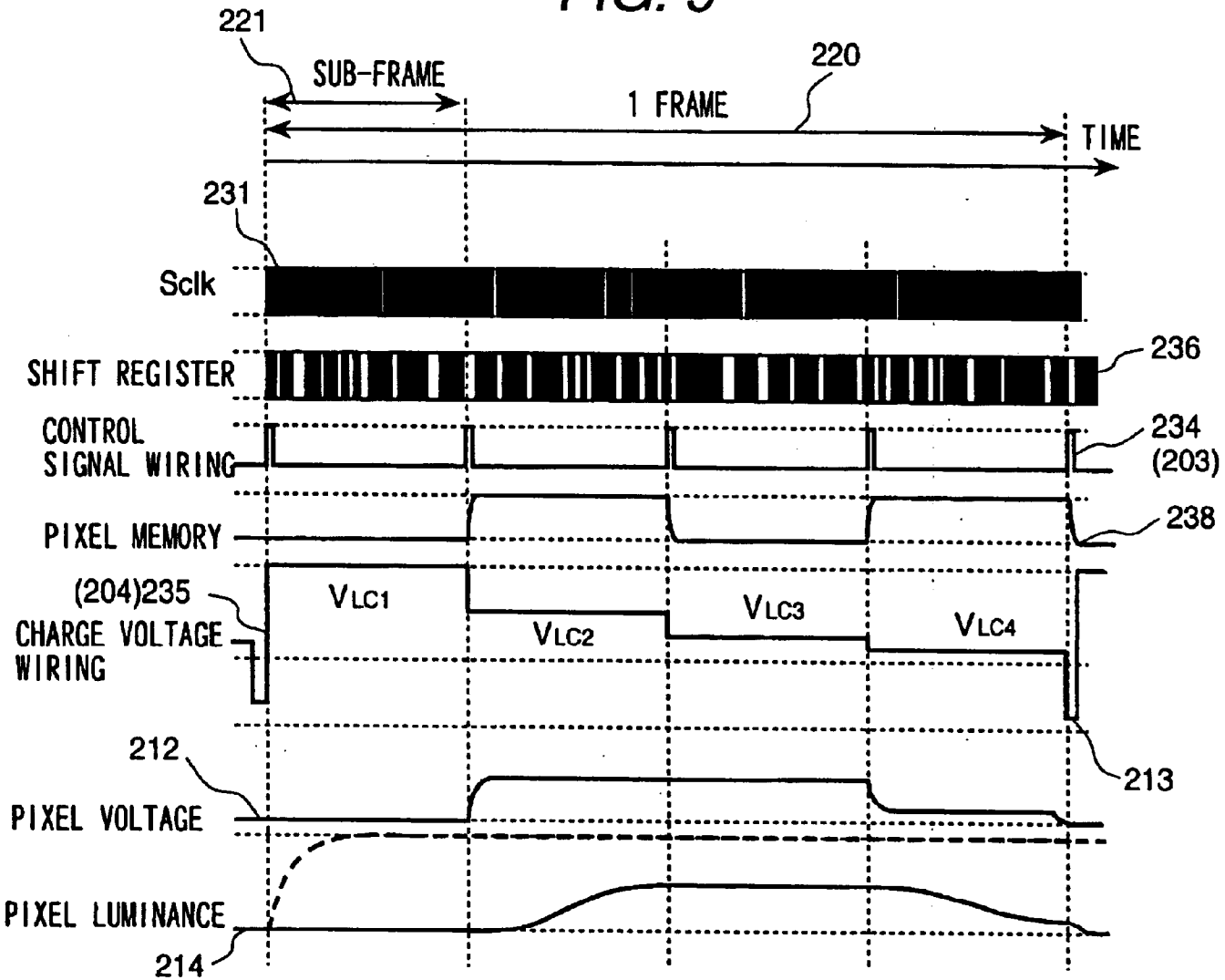
FIG. 9 is a waveform timing diagram showing a driving condition in the fifth embodiment of the present invention.

The operation shown in FIG. 9 is similar to the former embodiment except that the voltage 202 to be applied to the data signal wiring 102 is replaced with the shift register signal 236 output from the shift register 136. A discussion of the operation similar to the former embodiments will not be provided in order to avoid redundant discussion and maintain the disclosure simple enough to facilitate a clear understanding of the present invention. By this, the display data is mapped for the shift register 126 of the pixels in all display screens.

At this time, the display data signal for mapping is binary digital data representing the states of holding/writing. Furthermore, since the shift register 136 of each pixel drives the shift register 136 of the next pixel, the wiring delay can be small. As a result, high speed mapping can be carried out within quite a short period of time.

Accordingly, in the fifth embodiment, even within the sub-frame divided into n, satisfactory data mapping can be performed easily. After mapping display data using the shift register 136, by applying the data transfer voltage 234 to the control signal wiring 134, the shift register signal 236 is transferred as the potential 238 of the pixel memory 138 and held in the next sub-frame period.

Then, the conductive condition of the second active element 139 is controlled by the potential 238 of the pixel memory 138. As a result, it is determined whether the voltage 235 applied to the applied voltage wiring 135 is to be applied to the liquid crystal 112 or the voltage of the preceding sub-frame is to be held.

Here, an analog gradation value for the optical modulation element 111, namely the writing period of the voltage value of the applied voltage wiring 135, is comparable with the sub-frame period. Therefore, the writing period is a much longer period in comparison with the switching period of a PWM.

On the other hand, since the writing of an analog gradation value for the optical modulation element 111 and the mapping of display data are separate operations, no blanking period is present between the sub-frame displays, thereby to enable high speed rewriting of the image.

Accordingly, as set forth above, in the fifth embodiment, as a method of mapping the display data, by performing mapping using a shift register included in each pixel, high speed mapping in comparison with the third embodiment becomes possible. Therefore, a further increase in the display frequency becomes possible.

Sixth Embodiment

Next, a sixth embodiment of the present invention will be discussed with reference to FIG. 10, which is a circuit diagram showing a construction of the pixel structure in the sixth embodiment. In this case, with respect to the pixel circuit of the first embodiment, another set of a data signal wiring 102A and a first active element 106A, a first pixel memory 107, a first active element 108A, a second pixel memory 109A, a third active element 110A and an applied voltage wiring 104A are provided.

Figure 10:
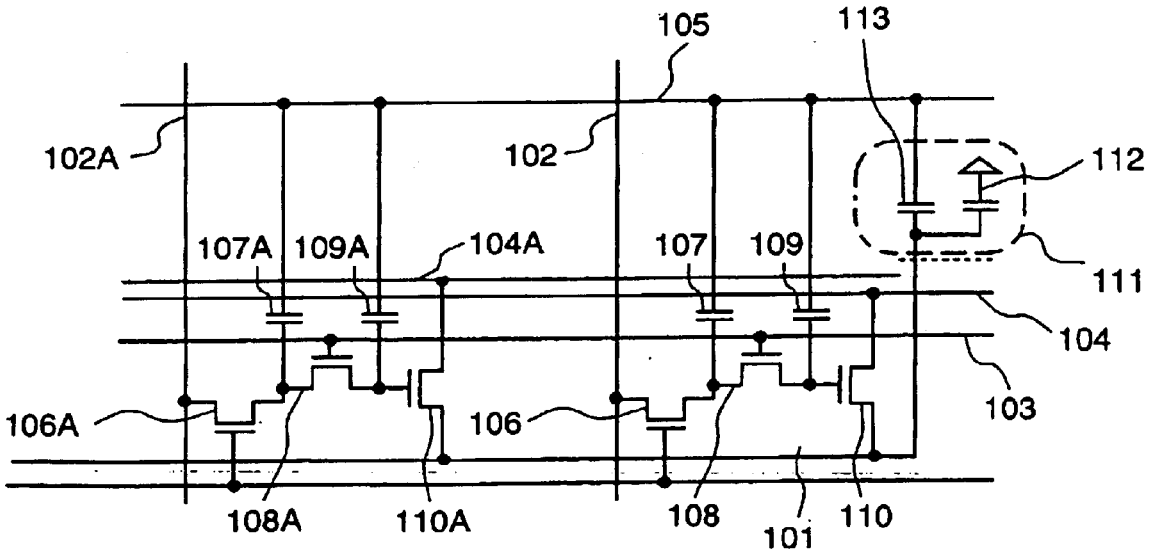
FIG. 10 is a circuit diagram of a pixel in the sixth embodiment of the present invention.

Accordingly, the operation of the pixel shown in FIG. 10 is similar to that of the first embodiment as observed individually. Therefore, a detailed discussion of the operations of respective components will not be provided so as to avoid redundant discussion and maintain a disclosure which is simple enough to facilitate a clear understanding of the present invention. In FIG. 10, the input signal voltage (corresponding to the voltage 202 of FIG. 1) to be applied to two data signal wiring 101 and 102A is configured to indicate three conditions of "none of the data signal wiring 102 and 102A is selected", "only data signal wiring 102 is selected" and "only data signal wiring 102A is selected".

Next, the operation of the sixth embodiment will be discussed with reference to FIG. 11.

Figure 11:
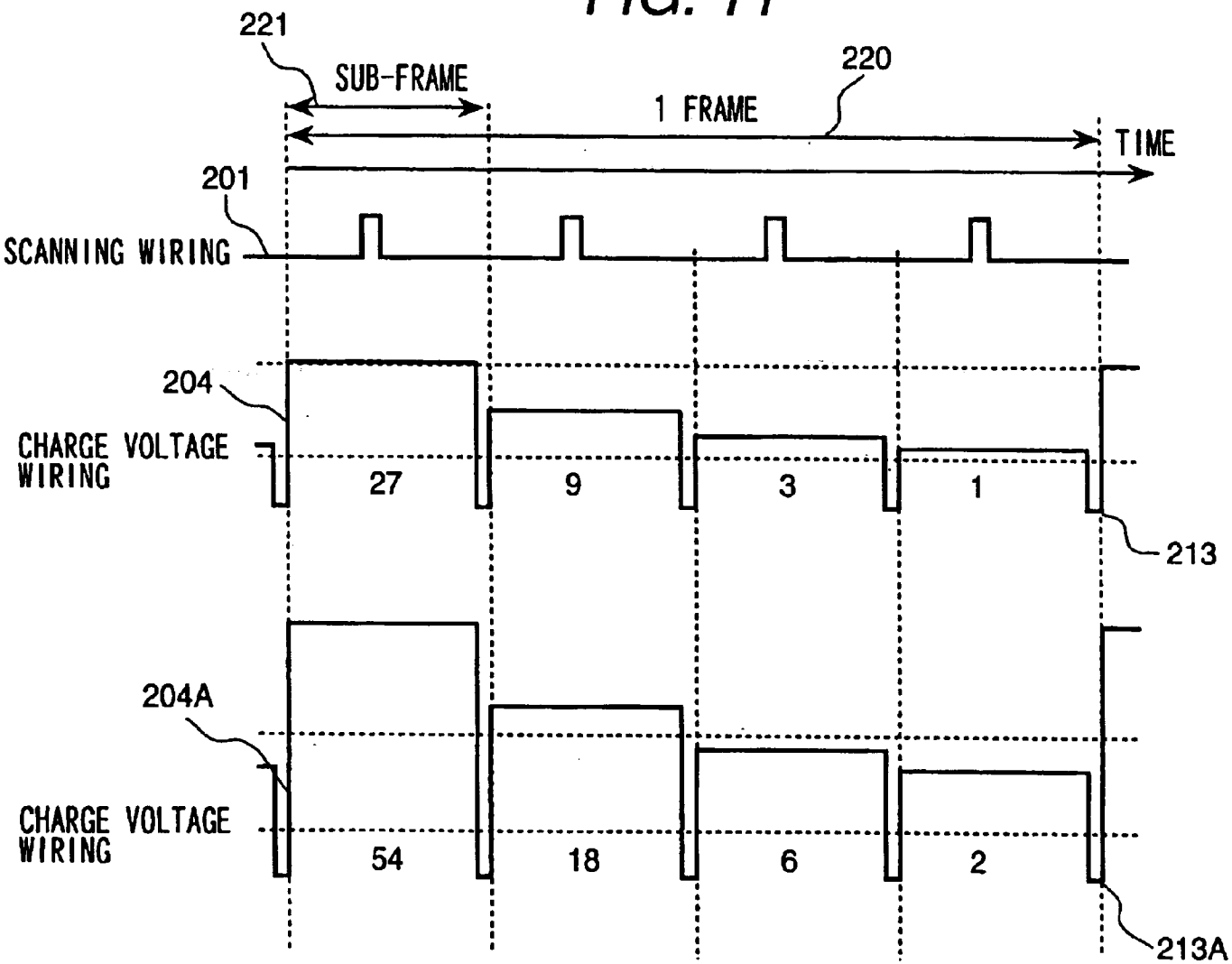
FIG. 11 is a waveform timing diagram showing a driving condition in the sixth embodiment of the present invention.

FIG. 11 shows a driving condition of a pair of pixels. As can be clear from this, while the condition of the sub-frame in one frame period and the timing of the voltage 201 supplied to the scanning wiring are similar to those in the first embodiments, voltages 204 and 204A to be applied to the applied voltage wiring 104 and 104A are different.

Namely, as shown, assuming the lowest voltage is 1, voltage 204 of n multiplied by 3 to the (m)th power, wherein m is an integer, such as 3, 9, 27, . . . is applied in each sub-frame. In the applied voltage wiring 104A, a voltage value double that of the voltage 204 is applied to the same frame.

Per each sub-frame, a voltage for the data signal wiring 102 and the data signal wiring 102A is used selectively. Then, in each sub-frame, the applied voltage wiring 104 and the applied voltage wiring 104A are selected and switched alternately or sequentially in each sub-frame. As a result, the voltage applied to the optical modulation element 111 is controlled at eighty-one values from 0 to 80.

Accordingly, in the sixth embodiment, with the construction and operation as set forth above, a gradation display by ternary notation is obtained. As a result, while the first embodiment, in which binary gradation display control is effected, sixteen gradation levels of display are obtained with four sub-frames, in the sixth embodiment, eighty-one gradation levels of display can be obtained with four sub-frames.

Here, in the sixth embodiment, the applied voltage wiring 102 and 102A are employed. The applied voltage wiring can be three or more. In this case, display of an even greater number of gradation levels can be obtained.

Furthermore, the method of driving the sixth embodiment may be combined with any of the driving methods of the first to fifth embodiments.

Seventh Embodiment

Next, a seventh embodiment of the present invention will be described.

Here, the driving methods of the third to fifth embodiments, namely employing the sub-frame luminance gradation modulation selective holding of the liquid crystal applied voltage of the preceding sub-frame or newly applying the voltage, are such that accurate gradation control for the input image data is not always guaranteed.

The seventh embodiment is premised on the fourth embodiment. In the seventh embodiment, a gradation histogram of the image to be displayed is detected. Depending upon the result of, detection of the gradation histogram, the voltage value 204 to be applied to the applied voltage wiring 104 in each sub-frame period is adjusted to obtain accurate gradation control for the input image.

Namely, in the seventh embodiment, for example, in the gradation histogram of the image to be displayed, for example, upon displaying a whitish image having a peak at a high portion of the gradation bit number, for displaying a high gradation portion in detail, the voltage is adjusted per sub-frame for application of the voltage near the voltage value shown in the high gradation level precisely.

When a liquid crystal for producing a black display upon absence of application of voltage is used as the optical modulation element, a particular voltage adjusting method is used in the seventh embodiment, as shown in FIG. 9. Assuming that the voltage value $V_{LC1}$ is a voltage value corresponding to the saturated luminance output for a white display, other voltage values $V_{LC2}$, $V_{LC3}$, $V_{LC4}$ are adjusted to be shifted to higher voltage values, respectively.

Then, in the seventh embodiment, the gradation information of the image to be displayed is detected to adjust the applied voltage and so forth according to the result of detection. In place of the display controller shown in FIG. 3, an expanded display controller 305 incorporating functions of gradation detection, gradation voltage control, data conversion and so forth is employed.

Figure 13:
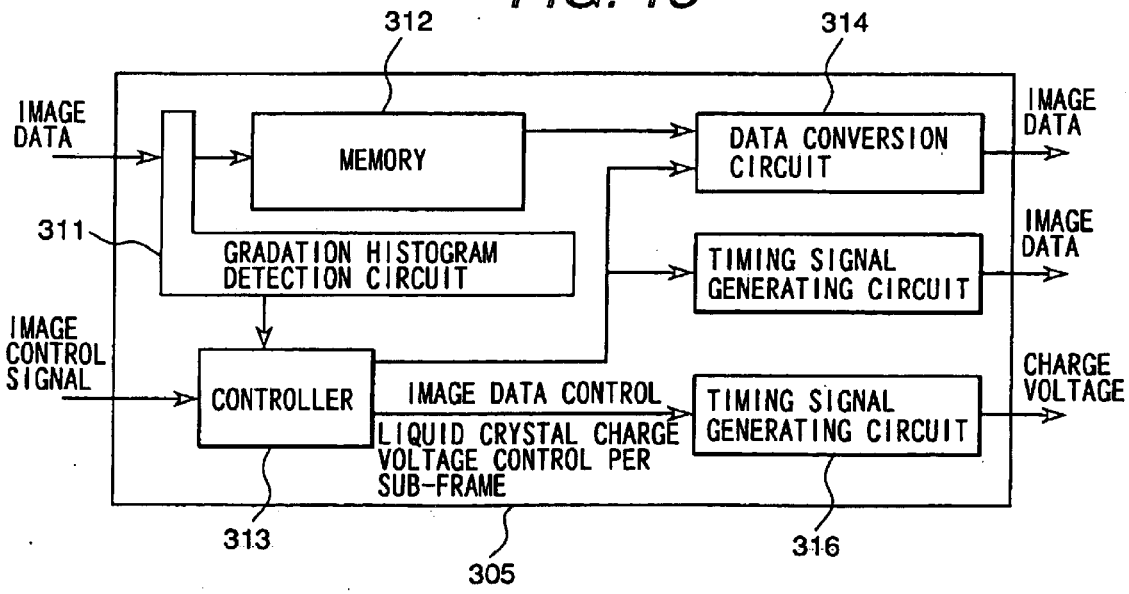
FIG. 13 is a block diagram of an expansion display controller in the seventh embodiment of the present invention.

FIG. 13 is a block diagram of the extended display controller 305. Here, the image data is input to a gradation histogram detection circuit 311. After sequential detection of gradation information, the detected gradation information is stored in the memory 312.

Figure 12:
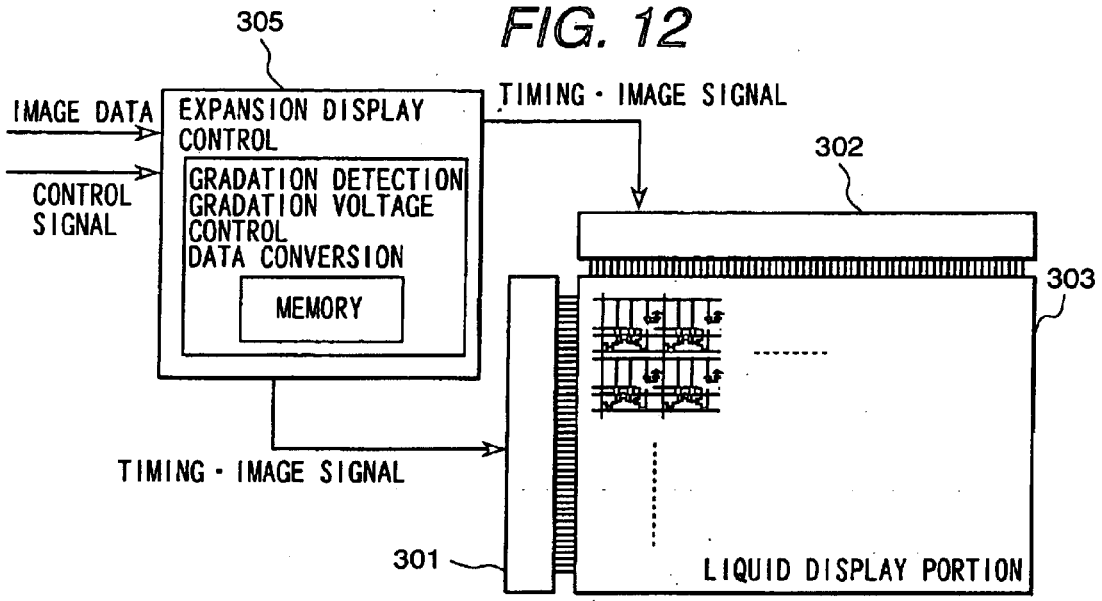
FIG. 12 is a diagram showing an overall construction of the seventh embodiment of the display apparatus according to the present invention.

It should be noted that the construction of FIG. 12 is the same as the construction of FIG. 3, except for the extended display controller 305. Discussion of the other than the extended display controller 305 will not be provided in order to avoid redundant discussion and maintain a disclosure which is simple enough to facilitate a clear understanding of the present invention.

After detection of gradation information of the image data for one screen image, the gradation histogram detection circuit 311 will aggregate that information to output it to a controller 313 as a gradation histogram for one display screen.

The controller 313 determines the applied voltage per each sub-frame on the basis of the gradation histogram for one screen image for outputting the voltage set per sub-frame by controlling the liquid crystal applied voltage generation circuit 316.

On the other hand, the controller 313 controls the data conversion circuit 314. The image data stored in the memory 312 is output by converting the image data corresponding to the applied voltage per sub-frame. Simultaneously, the timing signal generation circuit 315 is controlled to output the control signal.

Here, in the seventh embodiment, the gradation histogram per each color of RGB of the image data is used to control the voltage to be applied to each sub-frame. However, it is possible to detect a gradation histogram aggregating respective colors of RGB and to apply the same voltage to all of the pixel components per sub-frame.

With the construction set forth above, in the seventh embodiment, for multiple level gradation display, for using sub-frame luminance gradation modulation to hold the liquid crystal applied voltage in the preceding sub-frame and newly apply the voltage, the gradation information of the image to be displayed is detected to control the input-value of the luminance gradation in each sub-frame on the basis of the result of detection. Therefore, an even higher precision luminance gradation modulation system can be realized to obtain a display apparatus of higher performance.

Eighth Embodiment

In the seventh embodiment, when the applied voltage in each sub-frame is controlled by detecting gradation information of the image to be displayed, by narrowing the luminance gradation level range which can be modulated in one frame period, the luminance gradation modulation can provide a higher precision beyond the number of gradation levels of the input image data. However, in this case, it is wasteful to increase the gradation precision beyond that of the image information to be contained in the input image data. For example, in case of a display apparatus of 1024×768 pixels with 24 bits (8 bit in each color) of gradation display per pixel, about sixteen million kinds of colors can be displayed.

However, the number of pixels is about eight hundred thousand. Therefore, even when different colors are displayed in all pixels, only one twentieth can be used as a gradation range.

Accordingly, the number of sub-frames as a factor for increasing the number of gradation levels may be reduced to have a gradation precision of about the original image.

In practice, the number of colors displayed in one display screen is even smaller and further correlated. Therefore, the gradation range to be expressed is further limited. In this case, the number of sub-frames may be eight, for example, or even six or seven or a lesser number.

On the other hand, in the seventh embodiment, the gradation information is detected from the image to be displayed. Thus, it is possible to have a satisfactory display even at smaller bit number than the original gradation bit number. For example, there is the case when image data of black and white represented by two values (=1 bit) for displaying character information is input for the display apparatus, which can display image input of four bits per color. In such a case, it is wasteful to keep the number of sub-frames at four, as in the seventh embodiment. In such a case, the number of sub-frames can be set to one.

Therefore, the eighth embodiment detects a gradation histogram using the gradation histogram detecting circuit 311 of the extended display controller 305 and controls the controller 313 on the basis of the result of detection. By determining the number of sub-frames per one frame on the bas is of the result of detection, the voltage to be applied in each sub-frame is determined.

Here, even in the eighth embodiment, except for the extended display controller 305, the other construction and operation are the same as those in the seventh embodiment. Therefore, a discussion of the components other than the extended display controller 305 will not be provided in order to avoid redundant discussion and maintain a disclosure which is simple enough to facilitate a clear understanding of the present invention.

Figure 14:
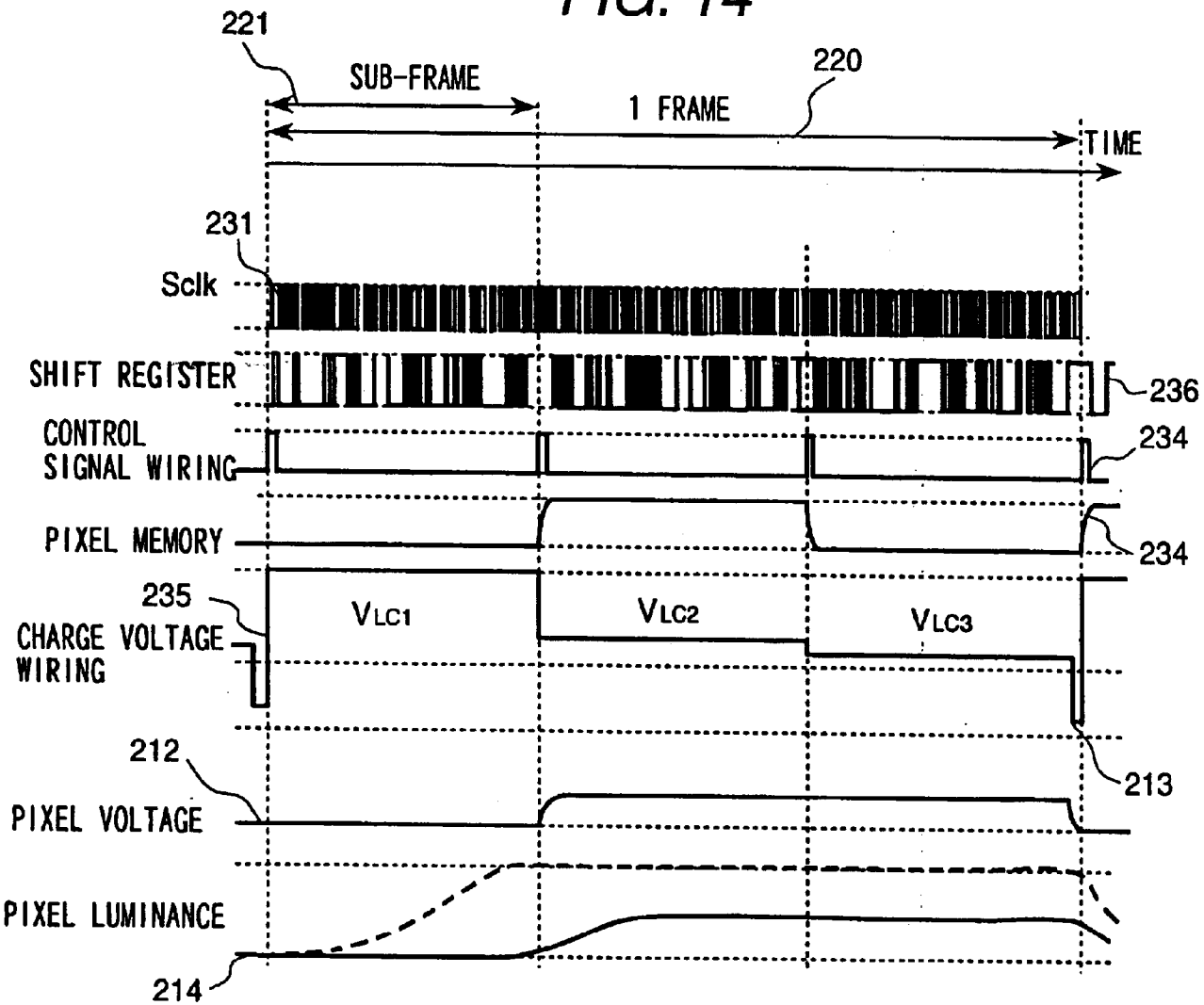
FIG. 14 is a waveform timing diagram showing a driving condition in the eighth embodiment of the present invention.

Next, the driving condition of the pixel in the eighth embodiment will be discussed with reference to FIG. 14. FIG. 14 shows the case where a display mode has four sub-frames, as shown in FIG. 9, switched into a display mode with three sub-frames at a certain timing. In case of the display mode with three sub-frames, as the pixel voltage 212, the voltage $V_{CL2}$ is applied as shown, and is held during the third sub-frame period.

With the eighth embodiment, the number of sub-frames is controlled depending upon the image data. Therefore, an average number of sub-frames per one frame can be reduced. As a result, it is further facilitated to adapt for a further increase of the display frequency.

In short, in the eighth embodiment, as a multiple level display method, the sub-frame luminance gradation modulation method as employed using selective holding of the voltage in the preceding frame and applying of new voltage, and the gradation information of the image to be displayed is detected for controlling the number of sub-frames in one frame and the input value of the luminance gradation in each sub-frame depending on the result of detection. Thus, it becomes possible to adapt to a higher display frequency.

Ninth Embodiment

Next, a ninth embodiment of the present invention will be described.

Here, the driving method in the eighth embodiment is a method for reducing the number of sub-frames when the display gradation number is small. The ninth embodiment is premised on the eighth embodiment and permits external control of the number of sub-frames in response to a display gradation number control signal supplied externally. Thus, the number of sub-frames can be reduced as required.

Figure 15:
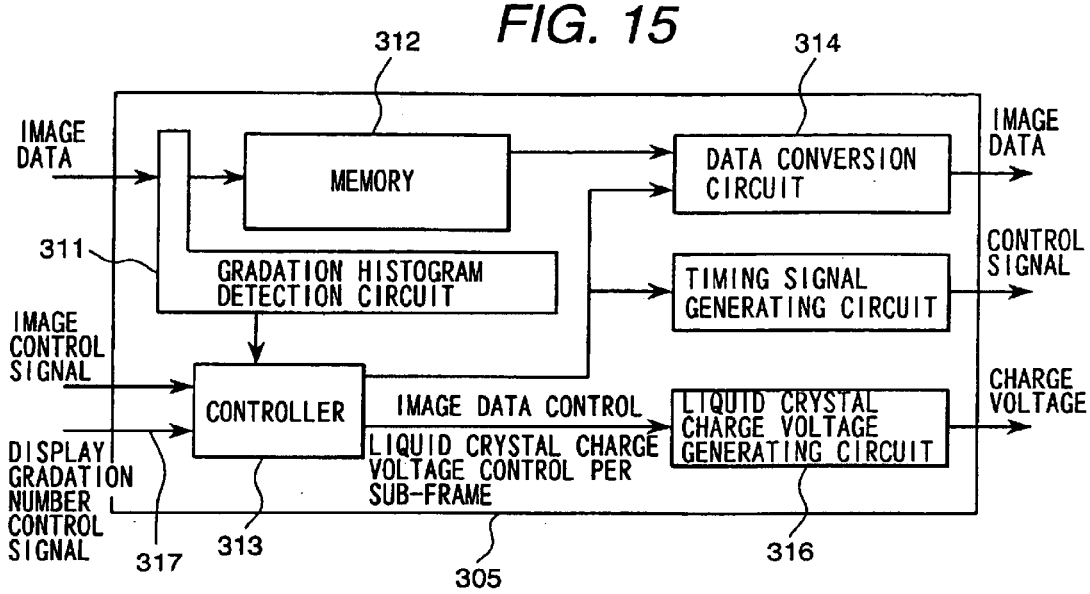
FIG. 15 is a block diagram of an expansion display controller in the ninth embodiment of the present invention.

Therefore, in the ninth embodiment, as shown in FIG. 15, the display gradation number control signal 317 is input to the extended display controller 305. Accordingly, the other construction and operation is the same as the eighth embodiment. The display gradation number control signal 317 can be a signal for varying the number of gradation levels in a range from the number of gradation levels of the input original image to the number of gradation levels of the image to be displayed.

Accordingly, in the ninth embodiment, by externally controlling the display gradation number control signal 317, the number of gradation levels of the image to be displayed can be made smaller than the number of gradation levels of the input original image. As a result, the number of sub-frames and the display frequency in one frame period can be reduced.

For example, the display gradation number control signal 317 may be controlled to permit the user of the display to input the signal or not. As a result, even when the number of display gradations concerns battery operation, it can be easily adapted even for power saving.

By the system for controlling the display apparatus, when the display apparatus is not used for a given period, the display gradation number control signal 317 is supplied to the extended display controller 305 for suppressing power consumption to achieve power saving.

As set forth above, in the ninth embodiment, for multiple level gradation display, for using sub-frame luminance gradation modulation to hold the liquid crystal applied voltage in the preceding sub-frame and newly apply the voltage, the gradation information of the image to be displayed is detected to control the input value of the luminance gradation in each sub-frame on the basis of the result of detection. Therefore, a very high precision luminance gradation modulation system can be realized, thereby to obtain a display apparatus of higher performance.

Furthermore, in the ninth embodiment, by adjusting the display gradation number control signal 317, the display gradation number can be reduced, whereby the number of sub-frames can be reduced without varying the length of one frame period, and so one sub-frame period can be made longer to lower the display frequency.

Tenth Embodiment

A tenth embodiment of the present invention will be described.

In case of the ninth embodiment, by adjusting the display gradation number control signal 317, one sub-frame can be made longer to permit lowering the display frequency. In contrast to this, in the tenth embodiment, when the number of sub-frames is reduced by reducing display gradation number, the sub-frame period can be shortened depending thereon. In this way, the frame period is shortened. As a result, in the tenth embodiment, the image rewriting frequency (refresh rate) can be made higher.

Figure 16:
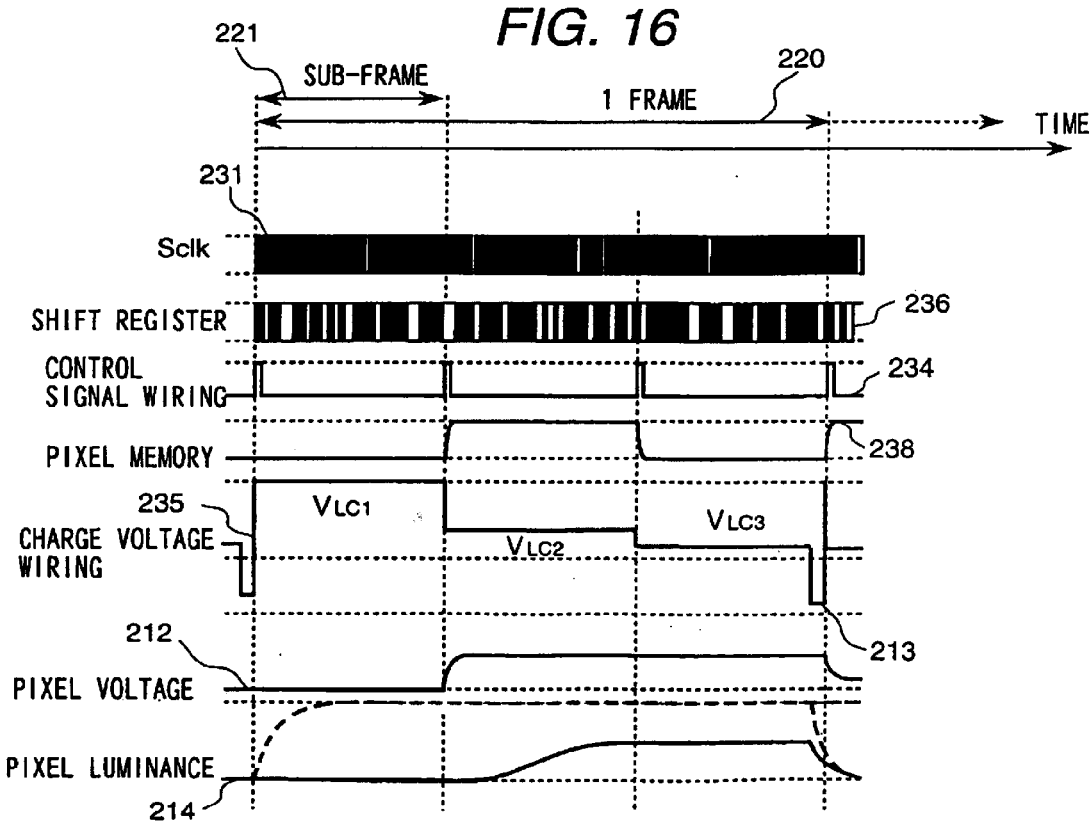
FIG. 16 is a waveform timing diagram showing a driving condition in the tenth embodiment of the present invention.

The driving condition of the pixel is shown in FIG. 16, which shows one embodiment of the case where the image display, which has been in a display mode with four sub-frames, is controlled to switch into a display mode with three sub-frames. In this case, one sub-frame period is unchanged when the display mode is varied. Thus, the frame period is made shorter.

As set forth above, in the tenth embodiment, for multiple level gradation display, for using sub-frame luminance gradation modulation to hold the liquid crystal applied voltage in the preceding sub-frame and newly apply the voltage, the gradation information of the image to be displayed is detected to control the input value of the luminance gradation in each sub-frame on the basis of the result of detection. Therefore, a very high precision luminance gradation modulation system can be realized, thereby to obtain a display apparatus of higher performance.

Eleventh Embodiment

Next, an eleventh embodiment of the present invention will be described.

In the ninth and tenth embodiments, when the number of display gradations is reduced by the display gradation number control signal 317, the display image quality is naturally lowered.

Therefore, in the eleventh embodiment, when the same gradation level is displayed over a plurality of frames, the controller 313 in the extended display controller 305 is provided with a function for adjusting the number of gradation levels of the image to be displayed over several frames by adjusting the input value for the luminance gradation to be newly applied in each sub-frame.

In this way, when the number of display gradation levels is reduced by the display gradation number control signal 317, lowering of the display image quality can be accommodated. Accordingly, by the eleventh embodiment, it becomes possible to easily provide a high performance display apparatus capable of producing an image display of high definition.

With the present invention, a TN type or IPS type liquid crystal may be used, even when using an optical modulation element having a relatively low response speed, and a sufficiently high display frequency can be attained so as to easily obtain a bright and high performance display apparatus at a low cost.

Although the present invention has been illustrated and described with respect to exemplary embodiments thereof, it should be understood by those skilled in the art that the foregoing and various other changes, omissions and additions may be made therein and thereto without departing from the spirit and scope of the present invention. Therefore, the present invention should not be understood as limited to the specific embodiments set out above, but is intended to include all possible embodiments which fall within a scope encompassed and equivalent thereof with respect to the features set out in the appended claims.

What is claimed is:

1. A display apparatus employing a system for separately performing mapping of display data for an optical modulation element of each pixel of all pixels forming an image to be display and application of gradation information, wherein:

each frame of said image is divided into a plurality of sub-frames;

an input value for said optical modulation element of each pixel is controlled independently per each sub-frame in said plurality of sub-frames;

said image is displayed with a gradation display obtained, using luminance amplitude modulation of each sub-frame, by applying the input value to said optical modulation element of each pixel during each sub-frame;

first gradation information is applied simultaneously with said mapping of the display data for said pixels;

second gradation information is applied for said pixel independently of said mapping; and said luminance amplitude modulation is performed per sub-frame simultaneously using said first gradation information and said second gradation information for obtaining said gradation display.

2. A display apparatus as claimed in claim 1, wherein said optical modulation element is constructed with a liquid crystal having a response speed longer than or equal to 5 msec.

3. A display apparatus as claimed in claim 1, wherein:

said mapping of the display data for said optical modulation element is performed with a construction of a substantially orthogonal two signal wiring and a first active element arranged at the intersection of said two signal wiring for performing mapping of the display data in a first memory of each pixel, and said application of gradation information for said optical modulation element is performed by transferring the display data mapped in said first memory to a second memory in each pixel by a second active element in each pixel, and the input value is applied to said optical modulation element by a third active element in each pixel.

4. A display apparatus as claimed in claim 1, wherein:

said mapping of the display data for said optical modulation element is performed by mapping of the display data in a first memory in each pixel using a shift register incorporated per one stage in said pixel, and said application of gradation information for said optical modulation element is performed by transferring the input value to said optical modulation element of each pixel according to the display data mapped in said first memory.

5. A display apparatus as claimed in claim 1, wherein:

when an image having a number of gradation levels of substantially $2^n$ is to be displayed, one frame period for displaying one frame of said image is divided into less than or equal to n in number of equal period sub-frames, each pixel in each sub-frame is selectively held at the input value for luminance gradation of a preceding frame according to the preliminarily mapped display data or the newly applied input value, and the input value for the luminance gradation to be newly applied in each sub-frame is mutually differentiated.

6. A display apparatus as claimed in any one of claims 1 to 4, wherein:

when an image having a number of gradation levels of substantially $2^n$ is to be displayed, one frame period for displaying one frame of said image is divided into n in number of equal period sub-frames, in each sub-frame, each pixel is selected into a display condition and a non-display condition according to preliminarily mapped display data, and an input value for luminance gradation of the pixel to display in each sub-frame is mutually differentiated.

7. A display apparatus as claimed in claim 6, wherein the input value for the luminance gradation of the pixel to be displayed in each sub-frame is any one of 1B, 2B, $2^2$B, . . . $2^n$B with taking the input value for the lowest luminance gradation is 1B.

8. A display apparatus as claimed in claim 6, wherein a total value or an effective value of all sub-frames of the input value for the luminance gradation of the pixel to be displayed in each sub-frame is substantially equal to the input value required for saturated luminance output of said optical modulation element.

9. A display apparatus as claimed in claim 1, wherein the pixel in a certain frame or a certain sub-frame is displayed using pixel information in a preceding frame or a preceding sub-frame in time.

10. A display apparatus employing a system for separately performing mapping of display data for an optical modulation element of each pixel of all pixels forming an image to be display and application of gradation information, wherein:

each frame of said image is divided into a plurality of sub-frames;

an input value for said optical modulation element of each pixel is controlled independently per each sub-frame in said plurality of sub-frames;

said image is displayed with a gradation display obtained, using luminance amplitude modulation of each sub-frame, by applying the input value to said optical modulation element of each pixel during each sub-frame;

when an image having a number of gradation levels of substantially $2^n$ is to be displayed, one frame period for displaying one frame of said image is divided into less than or equal to n in number of equal period sub-frames, each pixel in each sub-frame is selectively held at the input value for luminance gradation of a preceding frame according to the preliminarily mapped display data or the newly applied input value; and the input value for the luminance gradation to be newly applied in each sub-frame is mutually differentiated.

11. A display apparatus as claimed in claim 10, wherein the input value for the luminance gradation to be newly applied in each sub-frame is adjusted according to detection of gradation information of said image to be displayed.

12. A display apparatus as claimed in claim 11, wherein, when an image having a number of gradation levels of substantially $2^n$ is to be displayed, one frame period for displaying one frame of said image is divided into less than n in number of equal period sub-frames.

13. A display apparatus as claimed in claim 11, wherein the number of gradation levels of said image displayed is detected and the number of sub-frames in one frame period is adjusted depending upon result of detection of the number of gradation levels.

14. A display apparatus as claimed in claim 11, wherein the number of sub-frames in one frame period is adjusted by varying the number of gradation levels of said image displayed for adjusting a driving frequency.

15. A display apparatus as claimed in claim 11, wherein the number of sub-frames in one display period is adjusted by varying the number of gradation levels of said image displayed for adjusting the one frame period.

16. A display apparatus as claimed in claim 10, wherein the number of gradation levels of the image to be displayed over a several frame period is adjusted by adjusting the input value for luminance gradation to be newly applied in each sub-frame, per frame.

17. A display apparatus comprising:

a display to provide a visual display of an image formed by pixels, in a series of frames each frame having a plurality of sub-frames; and a display controller configured to receive image data, perform mapping of image data and application of gradation information separately, and transfer image data to the display for a visual display;

wherein said mapping of image data and application of gradation information include writing image data indicating whether a pixel is to be displayed in a sub-frame for each of the pixels forming said image, and subsequently, in a next sub-frame, applying the gradation information for only pixels selected to be displayed in written image data, and writing image data to each of said pixels and applying the gradation information to selected pixels simultaneously in each sub-frame, such that said image is displayed with a gradation display obtained by luminance amplitude modulation per sub-frame;

wherein first gradation information is applied simultaneously with said mapping of the display data for said pixel;

wherein second gradation information is applied for said pixel independently of said mapping; and wherein the luminance amplitude modulation is performed per sub-frame simultaneously using said first gradation information and said second gradation information for obtaining said gradation display.

18. A display apparatus comprising:

a display to provide a visual display of an image formed by pixels, in a series of frames each frame having a plurality of sub-frames, and each pixel being constructed with at least an optical modulation element; and a display controller configured to receive image data, perform mapping of image data and application of gradation information separately, and transfer image data to the display for a visual display of said image with a selected gradation display;

wherein said selected gradation display is obtained, using luminance amplitude modulation of each sub-frame, by applying an independent voltage value to the optical modulation element of each pixel in each of the plurality of sub-frames;

wherein first gradation information is applied simultaneously with said mapping of the display data for said pixel;

wherein second gradation information is applied for said pixel independently of said mapping; and wherein the luminance amplitude modulation is performed per sub-frame simultaneously using said first gradation information and said second gradation information for obtaining said selected gradation display.

19. A display apparatus as claimed in claim 18, wherein said optical modulation element of each pixel is constructed with a liquid crystal having a response speed no less than 5 msec and a holding capacitor arranged in parallel with the liquid crystal.

20. A display apparatus as claimed in claim 18, wherein:

said mapping of image data for said optical modulation element is performed by mapping of the image data in a first memory in each pixel using a shift register incorporated per one stage in said pixel, and said application of gradation information for said optical modulation element is performed by transferring an input voltage value to said optical modulation element value of each pixel according to the image data mapped in said first memory.

* * * * *